United States Patent [19]

Chiodo

[11] Patent Number: 4,869,617

[45] Date of Patent: Sep. 26, 1989

[54] PORTABLE HIGHWAY BARRIER

[76] Inventor: Alfred A. Chiodo, 2125 Willomere Dr., Des Moines, Iowa 50321

[21] Appl. No.: 242,151

[22] Filed: Sep. 9, 1988

[51] Int. Cl.[4] ..... E01F 13/00

[52] U.S. Cl. ..... 404/6; 404/13

[58] Field of Search ..... 404/6, 13; 256/1, 13.1

[56] References Cited

U.S. PATENT DOCUMENTS

| | | | |
|---|---|---|---|
| 3,877,681 | 4/1975 | Humphrey | 256/64 |
| 4,105,353 | 8/1978 | Bork | 404/6 |
| 4,298,186 | 11/1981 | Glass | 256/64 |
| 4,348,133 | 9/1982 | Trent | 256/13.1 |
| 4,557,466 | 12/1985 | Zucker | 256/13.1 |
| 4,624,210 | 11/1986 | Glass | 116/63 |
| 4,641,993 | 2/1987 | Hahne | 404/4 |
| 4,681,302 | 7/1987 | Thompson | 404/6 |
| 4,688,766 | 8/1987 | Zucker | 256/13.1 |
| 4,773,629 | 9/1988 | Yodock | 256/13.1 |

FOREIGN PATENT DOCUMENTS

| | | | |
|---|---|---|---|
| 1497860 | 1/1978 | United Kingdom | 256/13.1 |
| 2063973 | 6/1981 | United Kingdom | 256/13.1 |
| 2084635 | 4/1982 | United Kingdom . | |

*Primary Examiner*—Jerome W. Massie, IV
*Assistant Examiner*—Gay Ann Spahn
*Attorney, Agent, or Firm*—Zarley, McKee, Thomte, Voorhees & Sease

[57] ABSTRACT

The portable highway barrier of the present invention comprises an elongated barrier body made of light-weight material and having an open cavity therein. The barrier includes an elongated vertical channel at one end and an elongated vertical rib at the opposite end so that a plurality of barrier bodies can be placed in end to end relationship with the rib of one body inserted into the channel of the adjacent body. The barrier can be filled with water or other fluid material once it has been transported to the construction site.

2 Claims, 2 Drawing Sheets

PORTABLE HIGHWAY BARRIER

BACKGROUND OF THE INVENTION

This invention relates to a portable highway barrier.

During the construction and maintenance of highways, it is often necessary for the safety of the construction workers to provide barriers which separate the area of construction from the area where traffic may travel. These barriers are usually made with concrete and are elongated so that they can be placed in end to end relationship.

However, the concrete barriers presently used are extremely heavy, and the transporting of these barriers becomes a cumbersome and expensive task.

Therefore, a primary object of the present invention is the provision of an improved portable highway barrier.

A further object of the present invention is the provision of a portable highway barrier which is made of a lightweight hollow shell and which can be filled with a ballast material such as water, sand, or other fluid material at the construction site.

A further object of the present invention is the provision of an improved highway barrier which is hollow for containing a fluid material which includes means for removing the fluid material for transporting after construction is completed.

A further object of the present invention is the provision of an improved portable highway barrier which includes means at opposite ends thereof for permitting a plurality of the barriers to be retentively attached to one another in end to end relationship.

A further object of the present invention is the provision of an improved portable barrier, wherein the center of gravity can be made low so as to minimize the likelihood of tipping of the barrier during use.

A further object of the present invention is the provision of a barrier which is economical to manufacture, durable in use, and efficient in operation.

BRIEF DESCRIPTION OF THE INVENTION

The present invention includes an elongated body member which comprises a hollow shell having a cavity therein. At the top of the barrier are one or more fill openings for providing access to permit the insertion of water, granulated sand, or other fluid material into the cavity.

The end walls of the barrier include drain holes which can be opened to permit the fluid material in the cavity to be drained and removed therefrom.

One of the ends of the barrier includes a vertical channel providing a recess therein. The other end of the barrier includes a vertical rib which is sized and shaped to fit matingly within the recess at the opposite end of the barrier. With this construction, the barriers can be placed in end to end relationship with the rib of one barrier inserted within the recess of the adjacent barrier, so as to retentively hold the barriers in end to end alignment.

The barrier can be constructed of plastic or other lightweight material so that it can be easily transported to and from the site. Once at the site, the barrier is filled with water or other fluid material so as to give it weight and to maintain stability of the device during use.

DETAILED DESCRIPTION OF THE PREFERRED EMBODIMENT

Figure 1:
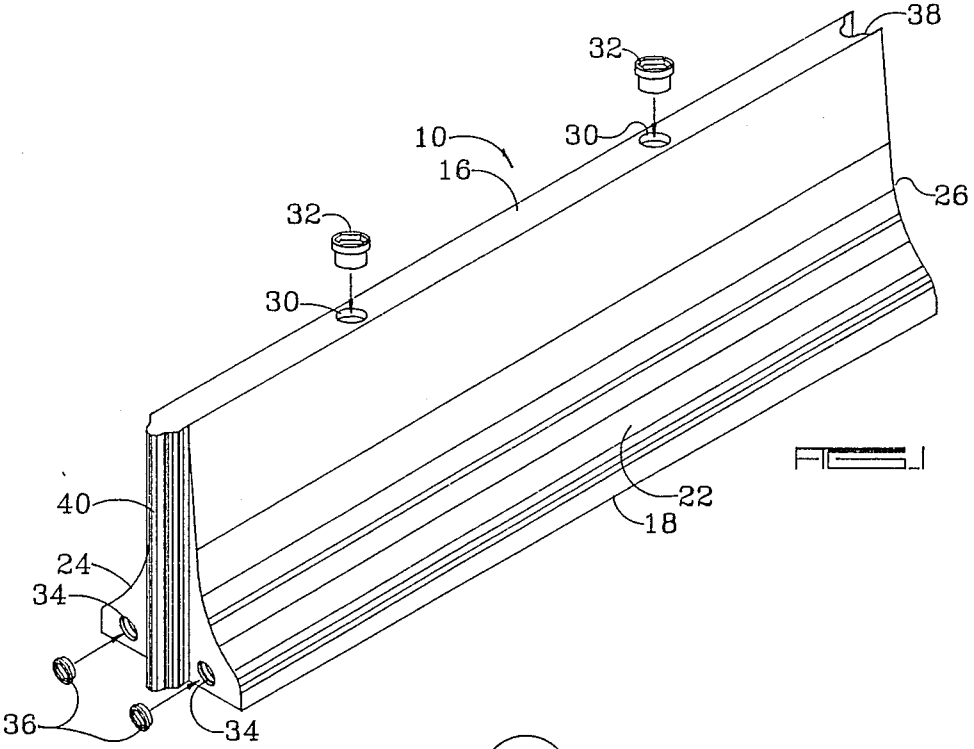
FIG. 1 is a perspective view of the present invention.

Referring to the drawings, the numeral 10 generally designates a barrier body member of the present invention.

Figure 2:
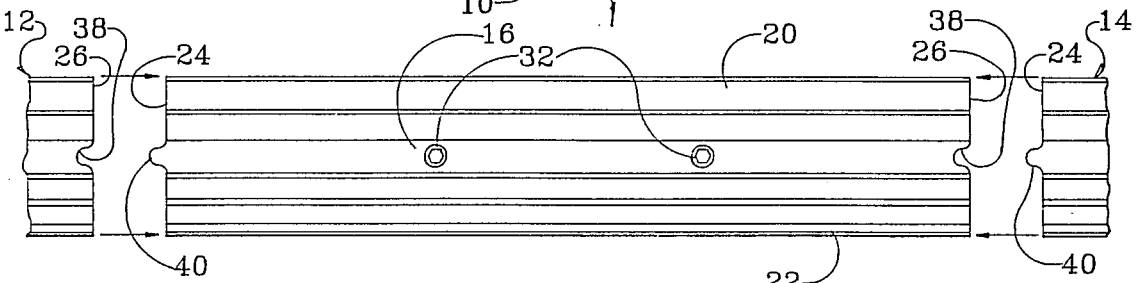
FIG. 2 is a top plan view of the barrier of the present invention showing the barrier placed in end to end relationship with other barriers of identical construction.
Figure 3:
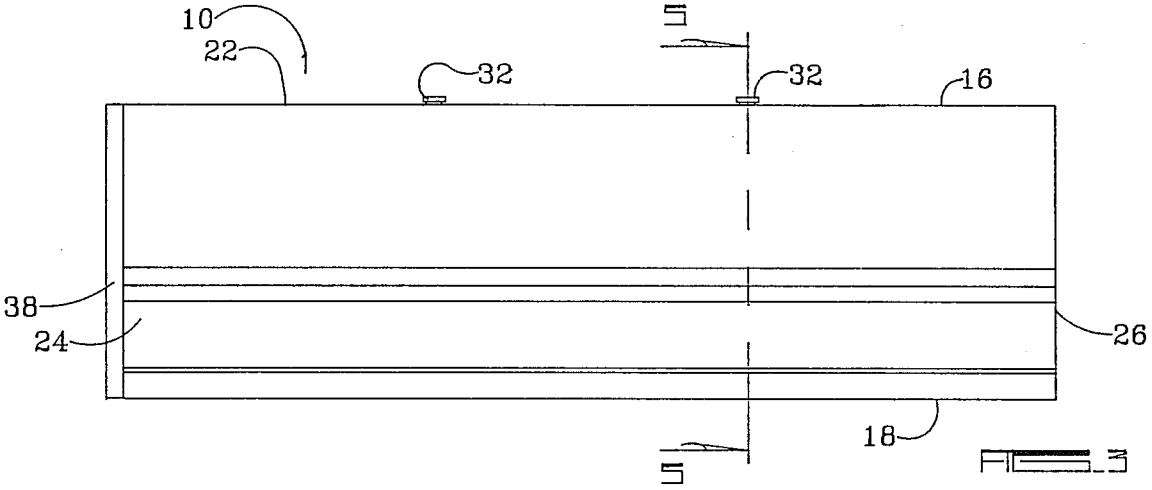
FIG. 3 is a front elevational view of the barrier of the present invention.

As seen in FIG. 2, additional barrier body members 12, 14, identical to body member 10, may be placed in end to end relationship with body member 10.

Body member 10 comprises an elongated top wall 16, a bottom wall 18 (FIG. 5), opposite side walls 20, 22, and opposite end walls 24, 26. Body member 10 is of hollow construction and includes a cavity 28 (FIG. 5) therein which extends throughout its length. It should be noted that top wall 16 has a width which is substantially less than bottom wall 18 so that the side walls extend downwardly from top wall 16 and diverge outwardly adjacent their lower ends where they join bottom wall 18. This gives cavity 28 a width at its lower end which is substantially greater than its width at the upper end. Top wall 16 is provided with one or more access openings 30 in which are inserted removable caps 32. Similarly, the end walls 24, 26 are each provided with one or more drain openings 34 in which are inserted drain caps 36. It should be noted that drain holes 34 are located adjacent bottom wall 18 so as to provide adequate drainage therefrom.

End wall 26 includes a vertical channel or recess 38 which extends vertically from bottom wall 18 to top wall 16. End wall 24 includes a vertical rib 40 which also extends the full vertical length of end wall 24 and which has a cross sectional configuration shaped and sized to fit matingly within the channel 38. As can be seen in FIG. 2, a plurality of body members 10, 12, 14 can be placed in end to end relationship with the ribs 40 protruding within the channels 38 so as to lock the body members together and hold them in vertical alignment.

The body members 10, 12, 14 are constructed of a lightweight material such as plastic or the like, and may be colored any particular color desired. Preferably, however, they should be colored some bright color which is easily seen and identified by motorists.

Figure 5:
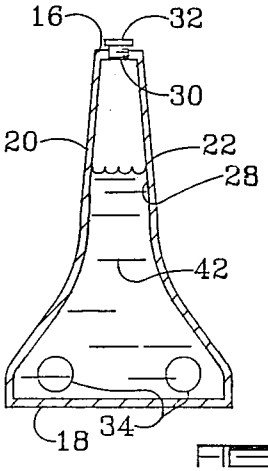
FIG. 5 is a sectional view taken along line 5—5 of FIG. 3.
Figure 4:
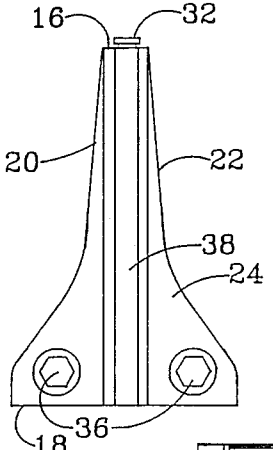
FIG. 4 is an end elevational view of the barrier as viewed from the right end of the barrier shown in FIG. 3.

In operation, the body members 10, 12, 14 as well as other body members are kept empty of fluid material therein so that they will be light in weight. They may be stored in that condition, and when they are needed, they are transported to the construction site. Once the body members are in place, they may be filled with water, sand, or other fluids so as to provide ballast and weight thereto. As can be seen in FIG. 5, the fact that the bottom of the cavity 28 is wider than the top of the cavity 28 causes the water 42 or other fluid material to have a substantially low center of gravity, thereby imparting stability to the barrier and helping to prevent the tipping or other movement of the barrier. The water is inserted through the fill openings 30, and the caps 32 are then placed in the fill openings 30.

After construction is complete, the drain caps 36 are removed to permit the water, sand, or other fluid material to drain out of the device. The device then can be easily lifted and loaded onto a vehicle for transporting to storage or to another construction site.

Thus, it can be seen that the device accomplishes at least all of its stated objectives.

What is claimed is:

1. A portable highway barrier comprising:

an elongated barrier body made of lightweight material and having a bottom wall, opposite end walls, a top wall, and opposite side walls, said top wall having a width less than said bottom wall, said side walls each having an upper end connected to said top wall and having a lower end connected to said bottom wall;

said lower ends of said side walls being substantially farther apart than said upper ends of said side wall;

said body having a hollow cavity therein extending along substantially all of its length;

a fluid material being contained within said cavity;

said top wall having a fill opening therein providing access to said cavity for pouring said fluid material into said cavity;

at least one of said end walls having at least one drain hole therein located adjacent said bottom wall for permitting the removal of said fluid material from said cavity;

a fill cap removably inserted within said fill opening;

a drain cap removably inserted within said drain hole;

one of said end walls having a continuous vertical channel extending between the bottom wall and top wall and axially inwardly therein, said channel having a cross sectional configuration of predetermined shape;

the other of said end walls having a continuous vertical rib extending between the bottom wall and the top wall and axially outwardly therefrom; said rib having a cross sectional configuration corresponding to said predetermined shape of said cross sectional configuration of said channel, and a second barrier body identical to said first mentioned barrier body, said first and second barrier bodies being placed in end to end relationship with said vertical rib of said first barrier body being matingly inserted into said vertical channel of said second body for retentively holding said first and second bodies in longitudinal alignment and against lateral side-to-side movement, said end walls of adjacent barriers abutting one another so as to engage and cover the drain caps on the adjacent barrier.

2. A portable highway barrier according to claim 1 wherein said cavities of said first and second body members have in cross section an upper portion and a lower portion, said lower portion having a width substantially greater than said upper portion whereby the center of gravity of said fluid material within said cavity is located adjacent said bottom wall.

* * * * *